US011267267B2

(12) United States Patent
Tahara

(10) Patent No.: US 11,267,267 B2
(45) Date of Patent: Mar. 8, 2022

(54) THERMAL-TRANSFER PRINTING APPARATUS, THERMAL-TRANSFER PRINTING SYSTEM, AND REVERSE UNIT

(71) Applicant: Dai Nippon Printing Co., Ltd., Tokyo (JP)

(72) Inventor: Yoshihiro Tahara, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 17/289,414

(22) PCT Filed: Aug. 6, 2020

(86) PCT No.: PCT/JP2020/030173
§ 371 (c)(1),
(2) Date: Apr. 28, 2021

(87) PCT Pub. No.: WO2021/065202
PCT Pub. Date: Apr. 8, 2021

(65) Prior Publication Data

US 2021/0354486 A1 Nov. 18, 2021

(30) Foreign Application Priority Data

Sep. 30, 2019 (JP) ..... JP2019-179877

(51) Int. Cl.
*B41J 3/60* (2006.01)
*B41J 15/04* (2006.01)
(Continued)

(52) U.S. Cl.
CPC ..... *B41J 15/042* (2013.01); *B41J 2/32* (2013.01); *B41J 3/60* (2013.01); *B41J 13/103* (2013.01)

(58) Field of Classification Search
CPC ..... B41J 15/042; B41J 2/32; B41J 3/60; B41J 13/103
See application file for complete search history.

(56) References Cited

U.S. PATENT DOCUMENTS 7,062,196 B2 * 6/2006 Nanno ..... B41J 3/60 399/107
2004/0114980 A1 6/2004 Nanno
(Continued)

FOREIGN PATENT DOCUMENTS

CN 1506771 A 6/2004
JP S60-082377 A1 5/1985
(Continued)

OTHER PUBLICATIONS

Machine translation of JP 2013-184767, published on Sep. 2013 (Year: 2013).*
(Continued)

*Primary Examiner* — Huan H Tran
(74) *Attorney, Agent, or Firm* — Burr & Brown, PLLC

(57) ABSTRACT

A thermal-transfer printing apparatus includes a roll-paper-supplying unit that rotates an image-receiving paper roll and unwinds and winds a roll type of first image-receiving paper, and a print unit that includes a thermal head for heating a thermal transfer sheet and that forms an image by transferring a color material from the thermal transfer sheet to the first image-receiving paper. With the image-receiving paper roll removed, a reverse unit that reverses a sheet type of second image-receiving paper is mountable in a region in which the image-receiving paper roll used to be contained. The print unit forms the image on the first image-receiving paper in a first printing mode in which the image-receiving paper roll is contained in the region, and the print unit forms an image on both surfaces of the second image-receiving
(Continued)

paper in a second printing mode in which the reverse unit is mounted on the region.

6 Claims, 7 Drawing Sheets

(51) Int. Cl.
*B41J 2/32* (2006.01)
*B41J 13/10* (2006.01)

(56) References Cited

U.S. PATENT DOCUMENTS

| | | | | |
|---|---|---|---|---|
| 2010/0245514 | A1* | 9/2010 | Kaimoto | B41M 5/502 347/104 |
| 2015/0298472 | A1 | 10/2015 | Kamitani et al. | |

FOREIGN PATENT DOCUMENTS

| | | | | |
|---|---|---|---|---|
| JP | 2013-184767 | * | 9/2013 | B65H 29/58 |
| JP | 2014-129172 | A1 | 7/2014 | |
| JP | 2014-148145 | A1 | 8/2014 | |
| JP | 5945917 | B2 | 7/2016 | |

OTHER PUBLICATIONS

International Search Report and Written Opinion (Application No. PCT/JP2020/030173) dated Oct. 20, 2020.
Chinese Office Action (Application No. 202080005266.9) dated Jul. 13, 2021.

* cited by examiner

THERMAL-TRANSFER PRINTING APPARATUS, THERMAL-TRANSFER PRINTING SYSTEM, AND REVERSE UNIT

TECHNICAL FIELD

The present invention relates to a thermal-transfer printing apparatus, a thermal-transfer printing system, and a reverse unit.

BACKGROUND ART

A thermal-transfer printing apparatus prints an image in a manner in which a color material surface of a thermal transfer sheet and image-receiving paper are brought into contact with each other and are heated with a thermal head pressed against a back surface of the thermal transfer sheet, and a color material on the thermal transfer sheet is transferred to the image-receiving paper. In some cases for the use of a photo book or a calendar, images are printed on both surfaces of image-receiving paper.

A thermal-transfer printing apparatus using rolled image-receiving paper obtained by winding long strip image-receiving paper is widely used. A roll type of image-receiving paper is excellent in transportability of a large amount of the image-receiving paper, stability of a paper-feeding operation within an apparatus, and costs per piece. However, the image-receiving paper tends to curl because the image-receiving paper is rolled, and a print curls in some cases. The print can be effectively inhibited from curling by using a sheet type of image-receiving paper. In consideration for user requests and the use of the print, a printer for printing on the roll type of image-receiving paper and a printer for duplex printing on the sheet type of image-receiving paper are preferably prepared. However, it is costly to prepare two printers.

PTL 1: Japanese Patent No. 5945917

SUMMARY OF INVENTION

The present invention has been accomplished in view of the matters described above, and it is an object of the present invention to provide a thermal-transfer printing apparatus, a thermal-transfer printing system, and a reverse unit that enable printing with a roll type of image-receiving paper and duplex printing with a sheet type of image-receiving paper to be performed at a low cost.

In one aspect of the present invention, a thermal-transfer printing apparatus includes a roll-paper-supplying unit that rotates an image-receiving paper roll and that unwinds and winds a roll type of first image-receiving paper, and a print unit that includes a thermal head for heating a thermal transfer sheet and that forms an image by transferring a color material from the thermal transfer sheet to the first image-receiving paper, wherein a paper-feeding unit that supplies a sheet type of second image-receiving paper is mountable, wherein, with the image-receiving paper roll removed, a reverse unit that reverses a surface of the second image-receiving paper that faces the thermal head while the second image-receiving paper travels in one direction is mountable in a region in which the image-receiving paper roll used to be contained, and wherein the print unit forms the image on the first image-receiving paper in a first printing mode in which the image-receiving paper roll is contained in the region, and the print unit forms an image on a surface of the second image-receiving paper and forms an image on the other surface of the second image-receiving paper that travels in the reverse unit and that is reversed in a second printing mode in which the reverse unit is mounted on the region.

In one aspect of the present invention, a thermal-transfer printing system includes a body containing a print unit that includes a thermal head for heating a thermal transfer sheet and that forms an image by transferring a color material from the thermal transfer sheet to image-receiving paper, and a roll-paper-supplying unit that rotates an image-receiving paper roll and that unwinds and winds a roll type of first image-receiving paper, and a reverse unit that is mountable in a region in which the image-receiving paper roll used to be contained in the body and that reverses a surface of a sheet type of second image-receiving paper that faces the thermal head while the second image-receiving paper travels in one direction, wherein the body includes a mounting portion with which an end portion of a holder that is fitted in a central hole of the image-receiving paper roll is engaged, and wherein the reverse unit includes a mounting part that is engaged with the mounting portion.

Advantageous Effects of Invention

According to the present invention, printing with a roll type of image-receiving paper and duplex printing with a sheet type of image-receiving paper can be performed at a low cost.

DESCRIPTION OF EMBODIMENTS

An embodiment of the present invention will hereinafter be described with reference to the drawings. In some drawings, the widths, thicknesses, lengths, and shapes of components, for example, are schematically illustrated unlike those of the actual components to make description clear. However, these are illustrated just by way of example and do not limit the interpretation of the present invention.

Figure 1A:
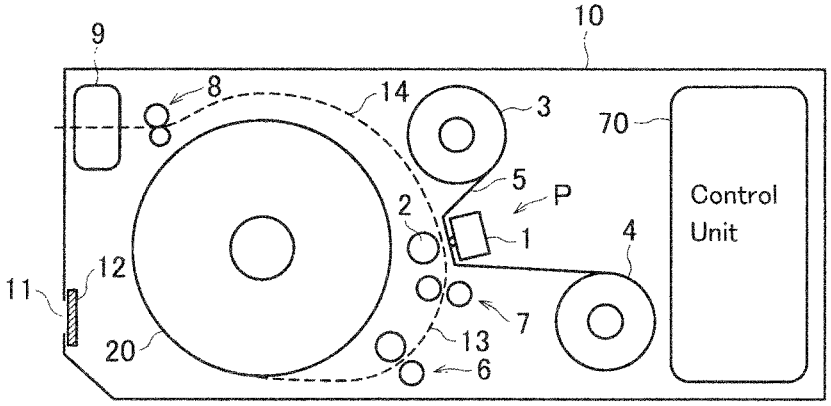
FIG. 1A and FIG. 1B illustrate a printing process on a roll type of image-receiving paper.
Figure 1B:
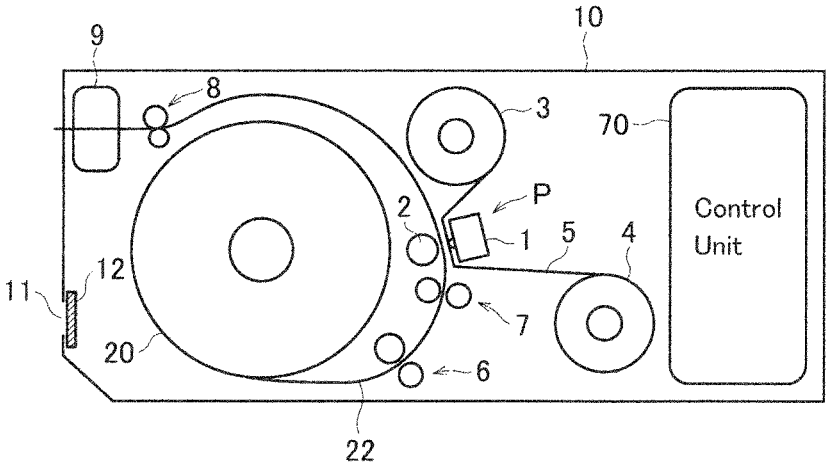

A thermal-transfer printing system according to the embodiment of the present invention includes a thermal-transfer printing apparatus and units that are mountable on the thermal-transfer printing apparatus such as a unit that supplies a sheet type of image-receiving paper and a unit that reverses the sheet type of image-receiving paper, and has a first printing mode in which an image is printed on a single surface of a roll type of image-receiving paper 22 as illustrated in FIG. 1A and FIG. 1B and a second printing mode in which images are printed on both surfaces of a sheet type of image-receiving paper 50 as illustrated in FIG. 2A, FIG. 2B, FIG. 3A, FIG. 3B, FIG. 4A, FIG. 4B, FIG. 5A, and FIG. 5B. The image-receiving paper 22 has a receiving layer on a surface of a base material. The image-receiving paper 50 has receiving layers on both surfaces of a base material.

The thermal-transfer printing apparatus includes a thermal head 1 that prints an image on image-receiving paper by sublimation transfer of Y, M, and C by using a thermal transfer sheet 5 on which a Y layer containing yellow dye (Y), a M layer containing magenta dye (M), a C layer containing cyan dye (C), and a protective (OP) layer are stacked in an interleaved format and that transfers the protective layer to the image. A meltable layer containing a color material such as a pigment or carbon black together with binder resin may be stacked on the thermal transfer sheet 5 in the interleaved format with respect to the Y layer, the M layer, and the C layer that are sublimation transfer dye layers in addition to the OP layer. The thermal transfer sheet 5 and the image-receiving paper 22, 50 may be a known sheet and known paper that are used for this kind of thermal-transfer printing apparatus.

The thermal transfer sheet 5 is wound around an unwinding portion 3. The thermal transfer sheet 5 that is unwound from the unwinding portion 3 passes through the thermal head 1, is wound around a winding portion 4, and is collected.

A platen roller 2 is disposed so as to face the thermal head 1 with the thermal transfer sheet 5 interposed therebetween. A print unit P that includes the thermal head 1 and the platen roller 2 interposes the image-receiving paper and the thermal transfer sheet 5 therebetween and forms an image by heating the back surface of the thermal transfer sheet 5 and transferring the dye to the absorbing layer of the image-receiving paper.

In the first printing mode, an image-receiving paper roll 20 around which the image-receiving paper 22 is wound is mounted on a body 10 of the thermal-transfer printing apparatus. A holder 24 (see FIG. 8B) is fitted in a central hole of the image-receiving paper roll 20. When a roll-paper-supplying unit (not illustrated) that is disposed on the body 10 rotates the holder 24 (forward rotation/backward rotation), the image-receiving paper roll 20 rotates, the image-receiving paper 22 is unwound (is conveyed to a downstream location) or is wound (is conveyed to an upstream location).

The image-receiving paper 22 that is unwound from the image-receiving paper roll 20 is conveyed to the print unit P along a conveyance path 13 (an upstream conveyance path). The image-receiving paper 22 that passes through the print unit P is conveyed toward an outlet along a conveyance path 14 (a downstream conveyance path). Conveyance rollers 6 and 7 are disposed on the conveyance path 13. A conveyance roller 8 and a cutter 9 are disposed on the conveyance path 14. Guide rollers (not illustrated) that can freely rotate are appropriately disposed on the conveyance paths 13 and 14. The conveyance paths 13 and 14 (image-receiving paper conveyance paths) are defined by the conveyance rollers 6 and 7, the guide rollers, and a space thereof.

A control unit 70 controls driving of the components of the thermal-transfer printing apparatus and performs a printing process. In the printing process, the positions of the image-receiving paper 22 and the Y layer of the thermal transfer sheet 5 are first adjusted, and the thermal head 1 comes into contact with the platen roller 2 with the image-receiving paper 22 and the thermal transfer sheet 5 interposed therebetween. Subsequently, the thermal head 1 selectively and sequentially heats the Y layer, based on image data while the image-receiving paper 22 and the thermal transfer sheet 5 are fed in predetermined directions, and Y is sublimation-transferred from the thermal transfer sheet 5 to the image-receiving paper 22.

After Y is sublimation-transferred, the thermal head 1 moves upward and is separated from the platen roller 2. Subsequently, the positions of the image-receiving paper 22 and the M layer of the thermal transfer sheet 5 are adjusted. M and C are sequentially sublimation-transferred to the image-receiving paper 22 in the same manner as a manner in which Y is sublimation-transferred. An image corresponding to one screen is formed on the image-receiving paper 22. Subsequently, the thermal head 1 transfers the protective layer (the OP layer) to the image.

The image-receiving paper 22 to which the protective layer is transferred is cut with a predetermined size by using the cutter 9, and a print that is made is discharged.

Figure 2A:
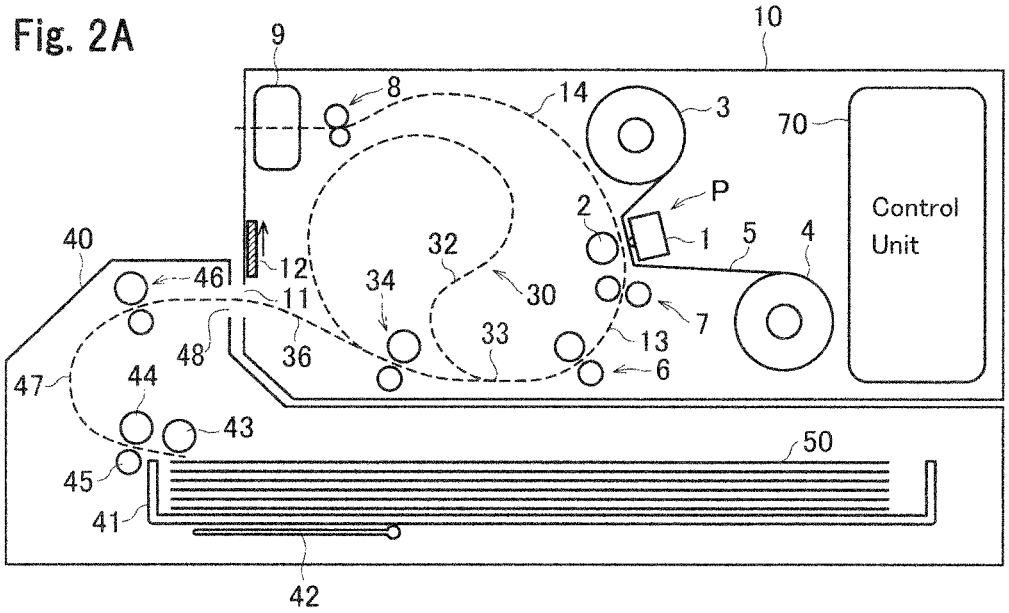
FIG. 2A and FIG. 2B illustrate a printing process on a sheet type of image-receiving paper.
Figure 7:
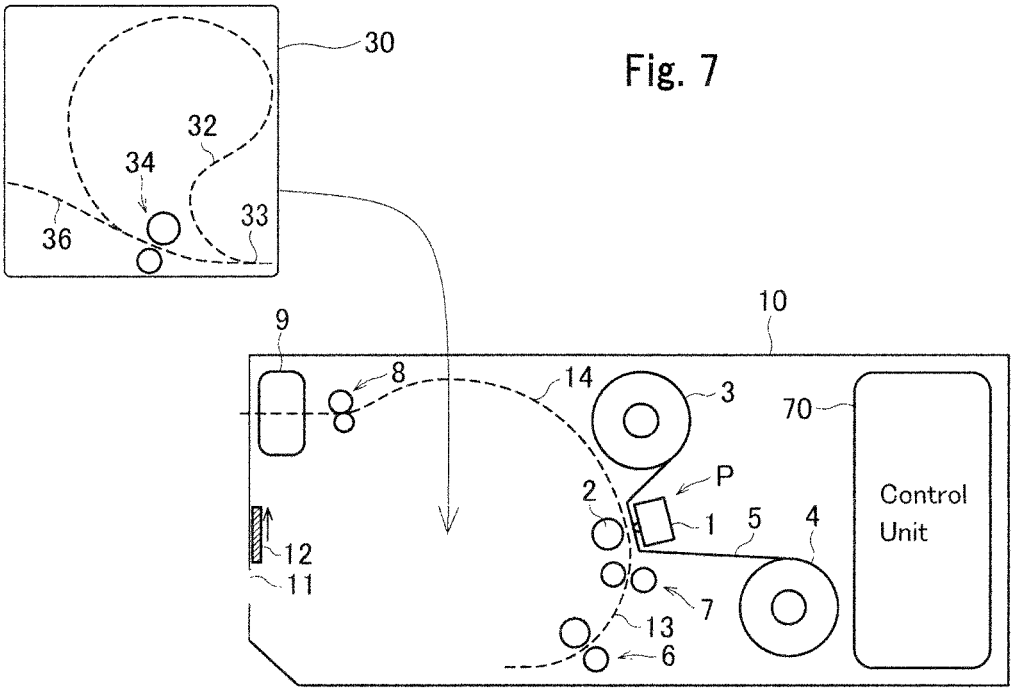
FIG. 7 schematically illustrates a reverse unit that is mounted on a body of the thermal-transfer printing apparatus.

In the second printing mode, as illustrated in FIG. 2A and FIG. 7, the image-receiving paper roll 20 is removed from the body 10, and a reverse unit 30 is mounted on a region in which the image-receiving paper roll 20 used to be contained. A paper-feeding unit 40 (a first paper-feeding unit) that supplies the sheet type of image-receiving paper 50 is mounted on the body 10. A shutter 12 that covers an opening portion 11 that is formed in a side surface of the body 10 is opened, and the opening portion 11 and a paper-feeding port 48 of the paper-feeding unit 40 are coupled with each other.

Figure 8A:
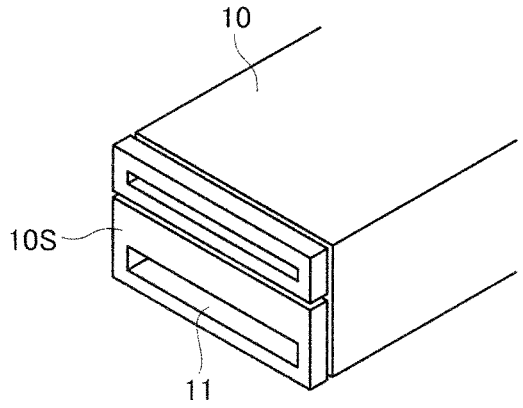
FIG. 8A and FIG. 8B illustrate perspective views of the body of the thermal-transfer printing apparatus.
Figure 8B:
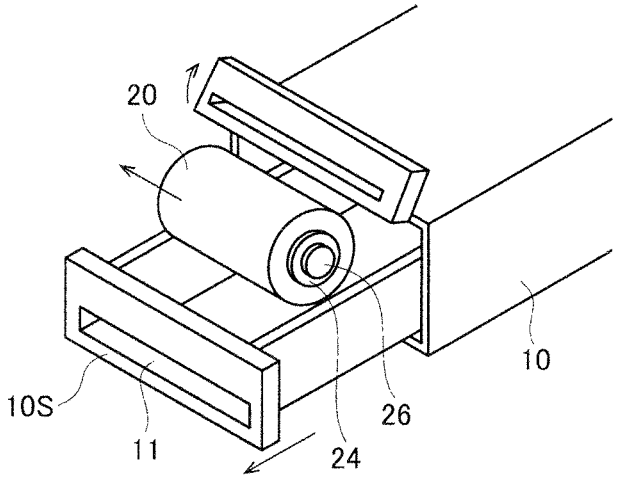

For example, as illustrated in FIG. 8A and FIG. 8B, a side surface 10S in which the opening portion 11 of the body 10 is formed is pulled, and the image-receiving paper roll 20 is removed from the body 10. The holder 24 (a winding axis component) of the image-receiving paper roll 20 is fitted in the central hole. When the image-receiving paper roll 20 is mounted on the body 10, an end portion 26 of the holder 24 in an axial direction is engaged with a mounting portion (not illustrated) of the body 10 and is secured.

The reverse unit 30 includes a mounting part (not illustrated) that has the same shape as the end portion 26 of the holder 24. The reverse unit 30 can be mounted on the body 10 by engaging the mounting part of the reverse unit 30 with the mounting portion of the body 10 as in the image-receiving paper roll 20.

As illustrated in FIG. 2A, the reverse unit 30 has a looped reverse conveyance path 32, a conveyance roller 34, and a guide conveyance path 36. An end portion 33 of the looped reverse conveyance path 32 is connected to the conveyance path 13. The end portion 33 functions as the entrance and exit of the looped reverse conveyance path 32. The looped reverse conveyance path 32 enables the image-receiving paper 50 a surface of which faces the thermal head 1 to be reversed such that the other surface faces the thermal head 1 while the image-receiving paper 50 travels in a direction.

The looped reverse conveyance path 32 has a substantially circular shape as a whole. The conveyance paths 13 and 14 and the print unit P are located along the outer circumference of the looped reverse conveyance path 32. A guide roller (not illustrated) that can freely rotate is appropriately disposed on the looped reverse conveyance path 32. The looped reverse conveyance path 32 (an image-receiving paper conveyance path) is defined by the conveyance roller 34, the guide roller, and a space thereof.

The guide conveyance path 36 couples the paper-feeding unit 40 and the looped reverse conveyance path 32 with each other. Specifically, an end of the guide conveyance path 36 is connected to the looped reverse conveyance path 32, and the other end thereof is connected to a conveyance path 47 of the paper-feeding unit 40. A guide roller (not illustrated) that can freely rotate is appropriately disposed on the guide conveyance path 36. The guide conveyance path 36 (an image-receiving paper conveyance path) is defined by the guide roller and a space thereof.

The paper-feeding unit 40 includes a container 41 in which the image-receiving paper 50 is stacked and contained and the conveyance path 47 along which the image-receiving paper 50 that is unwound from the container 41 is conveyed toward the body 10. A conveyance roller 46 and a guide roller (not illustrated) are disposed on the conveyance path 47.

Figure 2B:
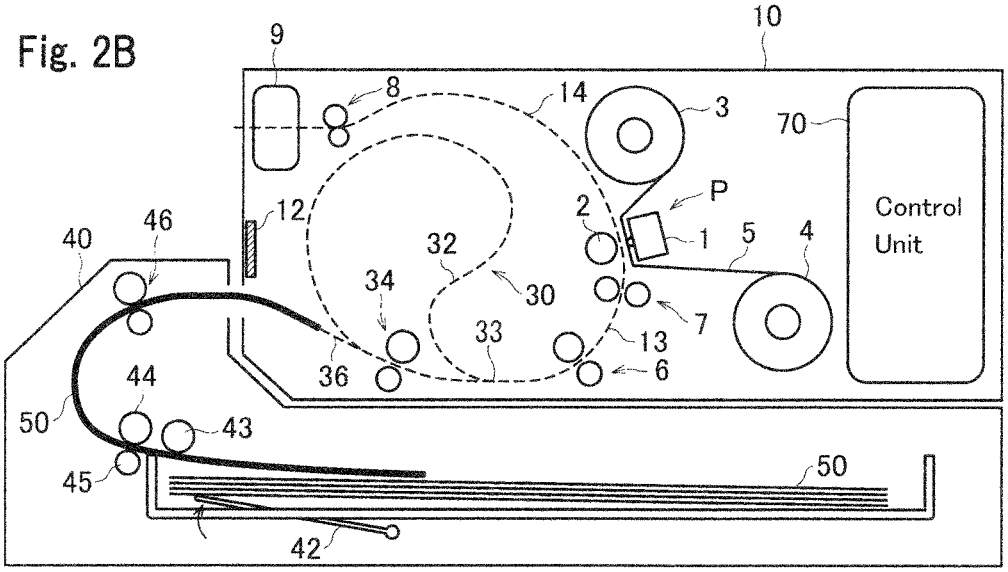

A pickup lever 42 that lifts the image-receiving paper 50 that is placed on a lift plate (a bottom plate) of the container 41 upward is disposed below the container 41. As illustrated in FIG. 2B, a piece of the image-receiving paper 50 in the uppermost layer among pieces of the image-receiving paper 50 lifted by the pickup lever 42 is fed by a pickup roller 43 toward the conveyance path 47.

A paper-feeding roller 44 and a separation roller 45 are disposed near the container 41 of the conveyance path 47. In the case where the piece of the image-receiving paper 50 in the uppermost layer and a piece of the image-receiving paper 50 in a lower layer are fed when the pickup roller 43 feeds the image-receiving paper 50 in the uppermost layer toward the conveyance path 47, the piece of the image-receiving paper 50 in the lower layer comes into contact with the separation roller 45 and is not fed toward the conveyance path 47.

The control unit 70 changes the printing mode from the first printing mode into the second printing mode automatically or based on an instruction from a user through, for example, a button operation when the reverse unit 30 is mounted, or when the shutter 12 is opened and the paper-feeding unit 40 is mounted on the body 10.

Figure 3A:
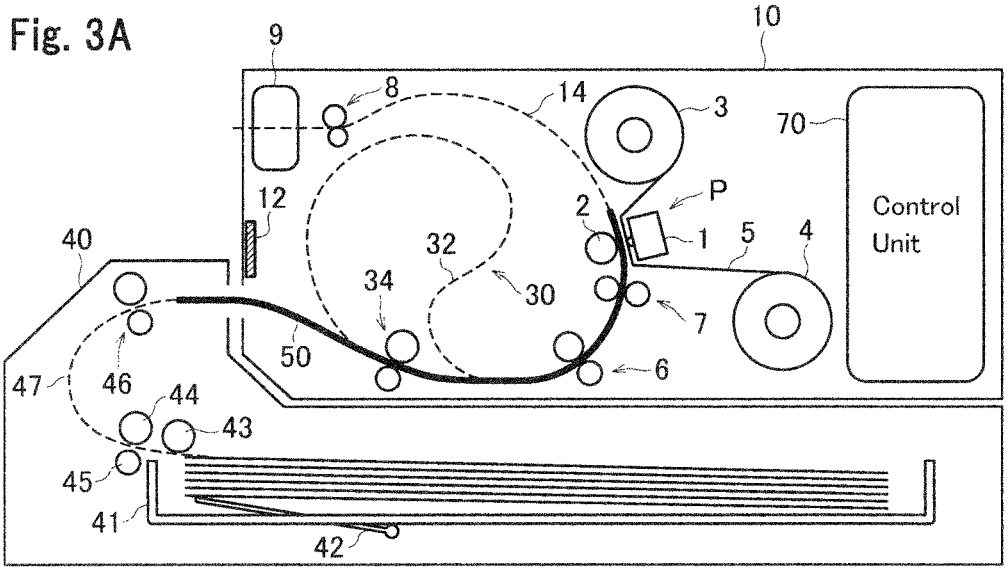
FIG. 3A and FIG. 3B illustrate the printing process on the sheet type of image-receiving paper.

As illustrated in FIG. 3A, the image-receiving paper 50 that is unwound from the container 41 is conveyed to the print unit P along the conveyance path 47, the guide conveyance path 36, a part of the looped reverse conveyance path 32, and the conveyance path 13.

Figure 3B:
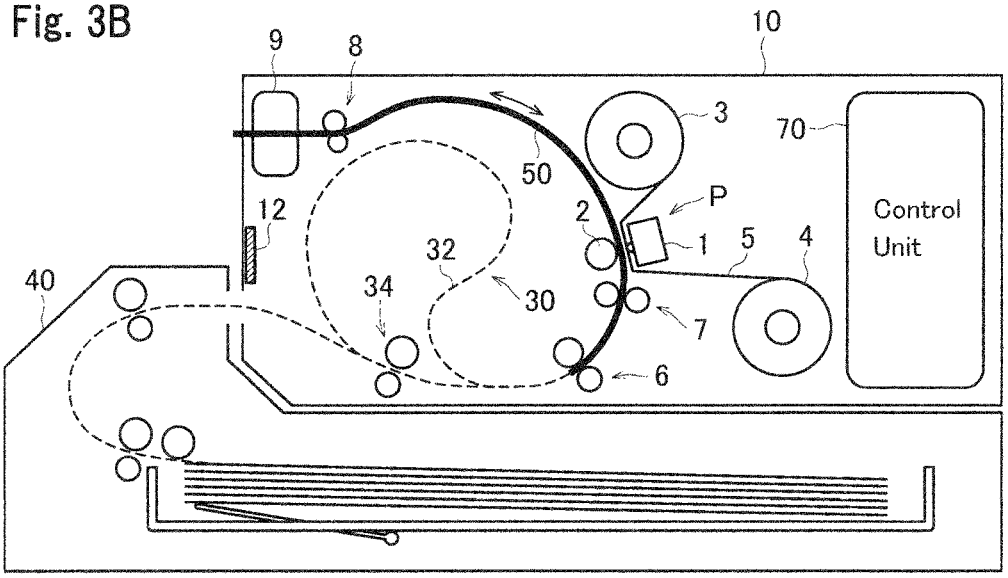

As illustrated in FIG. 3B, the print unit P prints an image on a surface of the image-receiving paper 50. A method of printing the image on the image-receiving paper 50 by using the print unit P is the same as a method of printing the image on the image-receiving paper 22.

Figure 4A:
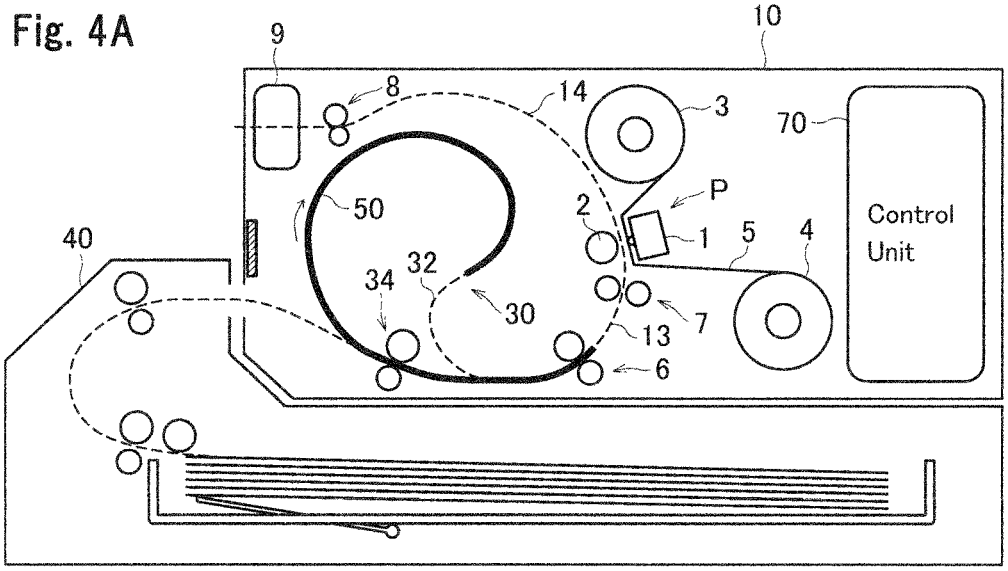
FIG. 4A and FIG. 4B illustrate the printing process on the sheet type of image-receiving paper.

As illustrated in FIG. 4A, the image-receiving paper 50 after the image is printed on the surface is fed to the looped reverse conveyance path 32 and travels in a direction along the looped reverse conveyance path 32 by means of the conveyance roller 34. In an example illustrated in FIG. 4A, the image-receiving paper 50 travels in the clockwise direction along the looped reverse conveyance path 32.

Figure 4B:
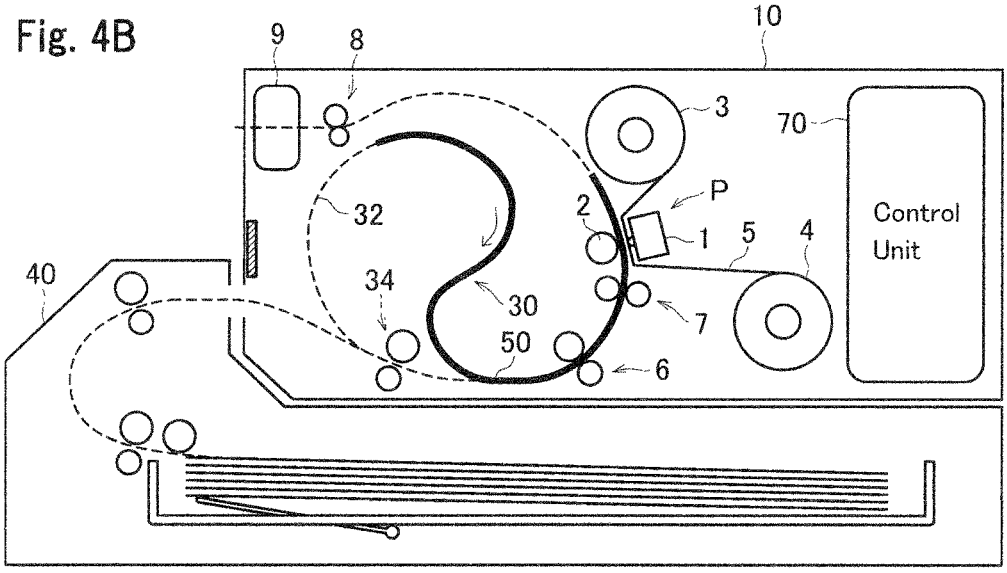

The image-receiving paper 50 that travels in the direction along the looped reverse conveyance path 32 is reversed while the image-receiving paper 50 travels along the looped reverse conveyance path 32, and the state thereof changes from a state in which the surface faces the thermal head 1 into a state in which the other surface faces the thermal head 1 as illustrated in FIG. 4B.

In order to cause the image-receiving paper 50 to travel in the clockwise direction along the looped reverse conveyance path 32, the length of a reverse path from the conveyance roller 34 to the conveyance roller 6 is shorter than the length of the image-receiving paper 50, and the image-receiving paper 50 is conveyed by the conveyance roller 34, the conveyance roller 6, or both.

Figure 5A:
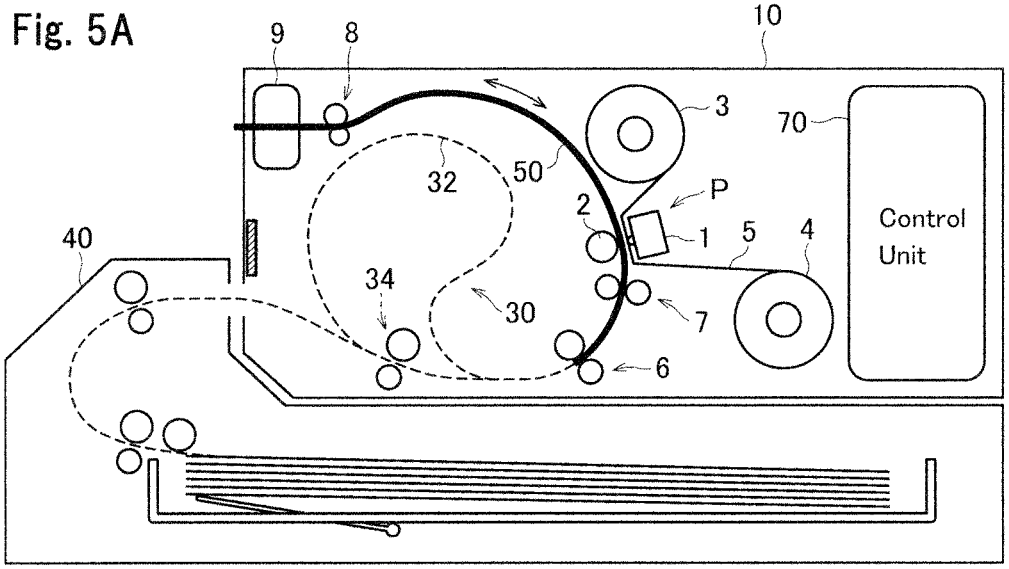
FIG. 5A and FIG. 5B illustrate the printing process on the sheet type of image-receiving paper.

The image-receiving paper 50 that is reversed while traveling in the direction along the looped reverse conveyance path 32 enters the conveyance path 13 and is conveyed to the print unit P. As illustrated in FIG. 5A, the print unit P prints an image on the other surface of the image-receiving paper 50.

Figure 5B:
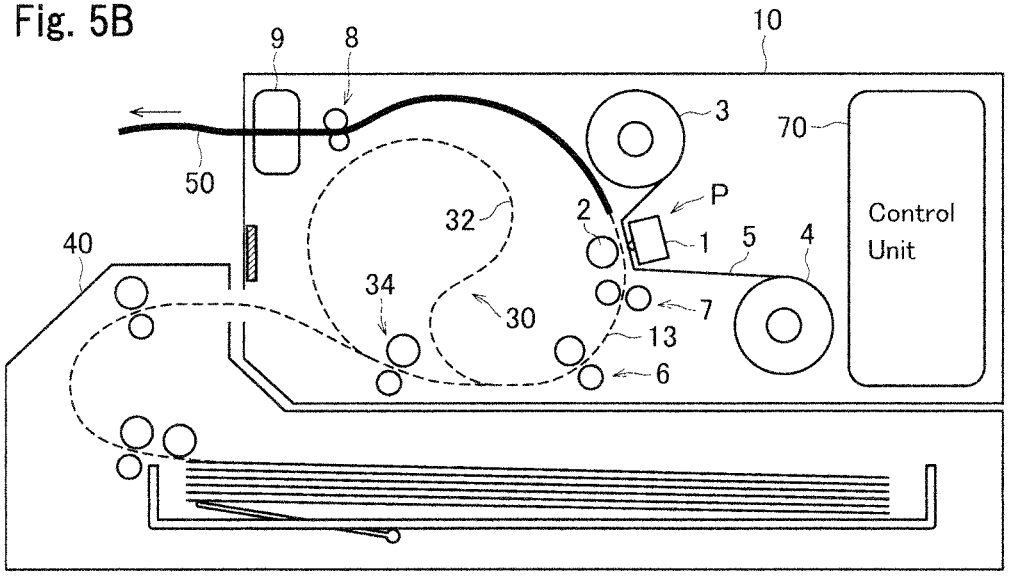

Subsequently, as illustrated in FIG. 5B, the image-receiving paper 50 after the images are printed on both surfaces is discharged to the outside via the conveyance path 14. At this time, the margins of a leading end portion and trailing end portion of the image-receiving paper 50 may be removed by the cutter 9.

According to the present embodiment described above, the single thermal-transfer printing apparatus enables printing on the roll type of image-receiving paper 22 to be performed and enables duplex printing on the sheet type of image-receiving paper 50 to be performed by mounting the reverse unit 30 and the paper-feeding unit 40. Costs can be lower than those in the case where two printers of a printer for printing on the roll type of image-receiving paper and a printer for duplex printing on the sheet type of image-receiving paper are prepared.

Since the image-receiving paper roll 20 is removed from the body 10, and the reverse unit 30 is mounted on the region in which the image-receiving paper roll 20 used to be contained, an apparatus size in the second printing mode changes only due to the paper-feeding unit 40, and the entire structure can be compact.

In an example according to the embodiment described above, duplex printing is performed on the sheet type of image-receiving paper 50. However, image-receiving paper that has an absorbing layer only on a surface of a base material may be contained in the container 41 of the paper-feeding unit 40, and the print unit P may perform printing on the single surface of the image-receiving paper.

Figure 6:
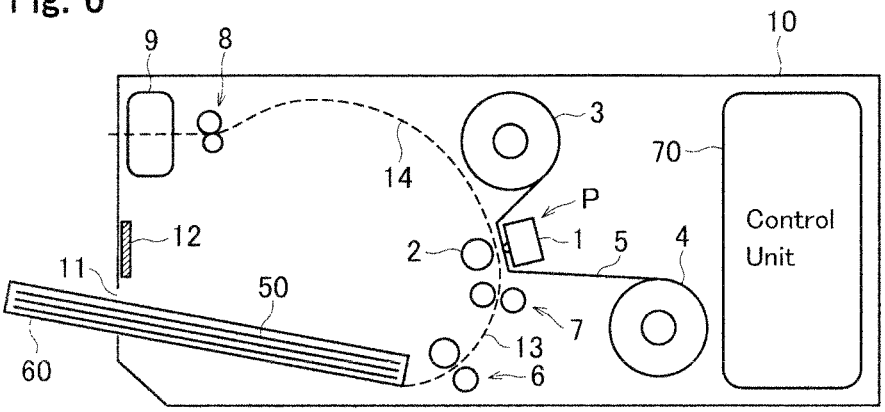
FIG. 6 schematically illustrates the structure of a thermal-transfer printing apparatus according to a modification.

In the case of printing on the single surface of the sheet type of image-receiving paper, as illustrated in FIG. 6, a paper-feeding unit 60 (a second paper-feeding unit) that supplies image-receiving paper 62 that has an absorbing layer on a surface of a base material may be inserted from the opening portion 11, and the image-receiving paper 50 that is unwound from the paper-feeding unit 60 may be fed to the conveyance path 13. The use of the paper-feeding unit 60 enables the distance of conveyance of the image-receiving paper to be shorter than that in the case of the paper-feeding unit 40 and enables the speed of the printing process to be increased.

In an example according to the embodiment described above, the image-receiving paper 50 is supplied from the paper-feeding unit 40 to the body 10. However, the paper-feeding unit 40 may not be used, and the image-receiving paper 50 may be manually supplied from the opening portion 11.

Although the present invention has been described in detail with reference to particular embodiments, it is apparent to a person ski lied in the art that various modifications can be made therein without departing from the spirit and scope of the present invention.

The present application is based on Japanese Patent Application No. 2019-179877 filed on Sep. 30, 2019, which is incorporate d herein by reference in its entirety.

REFERENCE SIGNS LIST

1 thermal head
2 platen roller
3 unwinding portion

4 winding portion
5 thermal transfer sheet
6, 7, 8 conveyance roller
10 body
20 image-receiving paper roll
22 image-receiving paper
24 holder
30 reverse unit
40 paper-feeding unit
50 image-receiving paper
70 control unit
P print unit

The invention claimed is:

1. A thermal-transfer printing apparatus comprising:

a roll-paper-supplying unit that rotates an image-receiving paper roll and that unwinds and winds a roll type of first image-receiving paper; and a print unit that includes a thermal head for heating a thermal transfer sheet and that forms an image by transferring a color material from the thermal transfer sheet to the first image-receiving paper, wherein a paper-feeding unit that supplies a sheet type of second image-receiving paper is mountable, wherein, with the image-receiving paper roll removed, a reverse unit is mountable in a region in which the image-receiving paper roll used to be contained, and the reverse unit reverses a surface of the second image-receiving paper that faces the thermal head while the second image-receiving paper travels in one direction, wherein the print unit forms the image on the first image-receiving paper in a first printing mode in which the image-receiving paper roll is contained in the roll-paper-supplying unit, and wherein the print unit forms an image on a surface of the second image-receiving paper and forms an image on the other surface of the second image-receiving paper that travels in the reverse unit and that is reversed in a second printing mode in which the reverse unit is mounted on the region.

2. The thermal-transfer printing apparatus according to claim 1, further comprising a conveyance path through which the first image-receiving paper that is unwound from the image-receiving paper roll is conveyed to the print unit, wherein the reverse unit has a looped reverse conveyance path and a guide conveyance path one end of which is connected to the looped reverse conveyance path and an other end of which is connected to the paper-feeding unit, and wherein an end portion corresponding to an entrance and an exit of the looped reverse conveyance path is connected to the conveyance path with the reverse unit mounted.

3. The thermal-transfer printing apparatus according to claim 1, wherein an opening portion that is formed in a body containing the roll-paper-supplying unit and the print unit is coupled with a paper-feeding port of the paper-feeding unit, and the paper-feeding unit is mounted.

4. A thermal-transfer printing system comprising:

a body containing a print unit that includes a thermal head for heating a thermal transfer sheet and that forms an image by transferring a color material from the thermal transfer sheet to image-receiving paper, and a roll-paper-supplying unit that rotates an image-receiving paper roll and that unwinds and winds a roll type of first image-receiving paper; and a reverse unit that is mountable in a region in which the image-receiving paper roll used to be contained in the body and that reverses a surface of a sheet type of second image-receiving paper that faces the thermal head while the second image-receiving paper travels in one direction, wherein the body includes a mounting portion with which an end portion of a holder that is fitted in a central hole of the image-receiving paper roll is engaged, and wherein the reverse unit includes a mounting part that is engaged with the mounting portion.

5. A reverse unit that is mountable in the region in which the image-receiving paper roll of the thermal-transfer printing apparatus according to claim 1 used to be contained and that reverses a surface of a sheet type of image-receiving paper that faces the thermal head while the sheet type of image-receiving paper travels in one direction.

6. The thermal-transfer printing apparatus according to claim 2, wherein an opening portion that is formed in a body containing the roll-paper-supplying unit and the print unit is coupled with a paper-feeding port of the paper-feeding unit, and the paper-feeding unit is mounted.

* * * * *